US008608454B2

(12) United States Patent
Wanschura et al.

(10) Patent No.: US 8,608,454 B2
(45) Date of Patent: Dec. 17, 2013

(54) COMBINED PUMP HOUSING FOR SEVERAL RATED QUANTITIES

(75) Inventors: Guenter Wanschura, Ulm (DE); Juergen Gintner, Elchingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 940 days.

(21) Appl. No.: 12/279,430

(22) PCT Filed: Mar. 9, 2007

(86) PCT No.: PCT/EP2007/002100

§ 371 (c)(1),
(2), (4) Date: Aug. 14, 2008

(87) PCT Pub. No.: WO2007/104496

PCT Pub. Date: Sep. 20, 2007

(65) Prior Publication Data

US 2009/0013861 A1 Jan. 15, 2009

(30) Foreign Application Priority Data

Mar. 10, 2006 (DE) ..... 10 2006 011 273
Dec. 11, 2006 (DE) ..... 10 2006 058 355

(51) Int. Cl.

| | |
|---|---|
| ***F04B 1/04*** | (2006.01) |
| ***F04B 27/04*** | (2006.01) |
| ***F04B 1/12*** | (2006.01) |
| ***F04B 27/08*** | (2006.01) |
| ***F01B 13/04*** | (2006.01) |

(52) U.S. Cl.
USPC ..... 417/271; 417/273; 417/269; 92/57

(58) Field of Classification Search
USPC ..... 417/269, 271, 273; 91/504; 92/57, 128
See application file for complete search history.

(56) References Cited

U.S. PATENT DOCUMENTS

| | | | | |
|---|---|---|---|---|
| 2,715,875 | A * | 8/1955 | Towler et al. | 417/269 |
| 2,980,077 | A * | 4/1961 | Magill | 74/22 R |
| 3,495,543 | A * | 2/1970 | Millard | 91/485 |
| 3,904,318 | A * | 9/1975 | Born et al. | 417/199.1 |
| 4,520,712 | A * | 6/1985 | Hovorka et al. | 91/505 |
| 4,594,055 | A * | 6/1986 | Hatakeyama et al. | 417/269 |
| 4,611,529 | A * | 9/1986 | Stricker et al. | 91/499 |

(Continued)

FOREIGN PATENT DOCUMENTS

| | | |
|---|---|---|
| DE | 41 30 225 C1 | 11/1992 |
| DE | 196 13 609 A1 | 10/1997 |

(Continued)

OTHER PUBLICATIONS

Notice of Reasons for Rejection issued in Japanese Application No. JP 2008-557677 dated Nov. 24, 2010 together with English language translation.

*Primary Examiner* — Charles Freay
*Assistant Examiner* — Alexander Comley
(74) *Attorney, Agent, or Firm* — Scully, Scott, Murphy & Presser, P.C.

(57) ABSTRACT

In a swash-plate type hydrostatic piston engine, a drive unit (10) and a swash plate (17) are received by a pot-shaped housing (1*b*). According to the invention, the pot-shaped housing (1*b*) is configured such that it is able to receive drive units (10*a*, 10*b*) of at least two rated quantities of a specific product series of the hydrostatic piston engine.

16 Claims, 5 Drawing Sheets

(56) References Cited

U.S. PATENT DOCUMENTS

| | | | | | |
|---|---|---|---|---|---|
| 4,620,475 | A * | 11/1986 | Watts | 91/499 |
| 4,780,061 | A * | 10/1988 | Butterworth | 417/371 |
| 4,792,287 | A * | 12/1988 | Alaze et al. | 417/269 |
| 5,241,822 | A * | 9/1993 | Pecnik et al. | 60/458 |
| 5,253,576 | A * | 10/1993 | Bethke | 92/12.2 |
| 5,354,180 | A * | 10/1994 | Forster | 417/199.1 |
| 5,388,974 | A * | 2/1995 | Streiff | 418/206.4 |
| 5,538,401 | A * | 7/1996 | Schaffner et al. | 417/222.1 |
| 5,685,215 | A * | 11/1997 | Jepsen et al. | 92/71 |
| 5,794,515 | A * | 8/1998 | Bethke | 92/128 |
| 5,862,704 | A * | 1/1999 | Seljestad | 74/60 |
| 5,931,645 | A * | 8/1999 | Goto et al. | 417/269 |
| 5,971,717 | A * | 10/1999 | Berthold | 417/269 |
| 6,217,289 | B1 * | 4/2001 | Smith | 417/199.1 |
| 6,405,634 | B1 * | 6/2002 | Hansen | 92/71 |
| 6,406,271 | B1 * | 6/2002 | Valentin | 417/269 |
| 6,499,962 | B1 * | 12/2002 | Keiner et al. | 417/269 |
| 6,565,329 | B2 * | 5/2003 | Yokomachi et al. | 417/269 |
| 6,663,354 | B2 * | 12/2003 | Forster | 417/222.1 |
| 6,694,729 | B1 * | 2/2004 | Trimble | 60/444 |
| 2004/0228740 | A1 * | 11/2004 | Matsumoto et al. | 417/269 |
| 2004/0247454 | A1 * | 12/2004 | Donders | 417/269 |
| 2005/0135953 | A1 * | 6/2005 | Reverberi et al. | 417/521 |
| 2006/0039801 | A1 * | 2/2006 | Dong et al. | 417/269 |
| 2006/0051229 | A1 * | 3/2006 | Thoms et al. | 418/61.3 |
| 2007/0269325 | A1 * | 11/2007 | Candio et al. | 418/9 |

FOREIGN PATENT DOCUMENTS

| | | | | |
|---|---|---|---|---|
| FR | 979 507 | A | 4/1951 | |
| JP | 5-38364 | U | 5/1993 | |
| JP | 6-10827 | A | 1/1994 | |
| JP | 2002-202048 | A | 7/2002 | |
| JP | 3570517 | B2 | 9/2004 | |
| JP | 2004-300985 | A | 10/2004 | |
| WO | WO 2005/085642 | A1 | 9/2005 | |
| WO | WO 2005085642 | A1 * | 9/2005 | F04C 23/00 |

* cited by examiner

COMBINED PUMP HOUSING FOR SEVERAL RATED QUANTITIES

BACKGROUND

The invention relates to a swash-plate type hydrostatic piston engine, which is configured with a pot-shaped housing which is the same for at least two rated quantities of a product series.

The invention further relates to a swash-plate type hydrostatic piston engine, the housing of which is also of pot-shaped configuration, comprising at its front end, to which a driving shaft with external drive elements may be connected, a lid-shaped bearing flange.

Swash-plate type hydrostatic piston engines are known in numerous constructions, for example from DE 196 13 609 A1. A drawback with this known swash-plate type hydrostatic piston engine is, however, that the housing is only suitable for one respective rated quantity of a specific construction and thus for every rated quantity of the product series a separate housing has to be made.

The object of the invention, therefore, is to develop a swash-plate type piston engine, such that as many components as possible may be used for different rated quantities of the product series and/or such that by ensuring a simple construction, a construction which is stable and easy to assemble is also achieved.

The above object can be achieved by a first exemplary aspect of the present invention.

SUMMARY

In the hydrostatic piston engine according to the first exemplary aspect of the invention, the housing is configured as a pot-shaped housing and optionally it may accommodate different drive units of different rated quantities of the hydrostatic engine. As a result, the piston engine is suitable for optionally mounting one of two drive units of different rated quantities in one housing, which is the same for at least two rated quantities of a product series. In the embodiment according to the invention, therefore, the production cost and also the supply cost is substantially reduced as the same pot-shaped housing may be used for at least two rated quantities of a product series. As a result, the manufacturing costs may also be substantially reduced and the storage simplified.

Within the scope of the invention, the drive units may respectively be formed by only one cylinder drum. However, the cylinder drum with the corresponding pistons and/or the corresponding control plate and/or the corresponding swash plate may respectively form a different drive unit.

The invention is suitable for a hydrostatic piston engine, in particular an axial piston engine, with both a constant and adjustable throughput volume. In the last case, an adjusting device which preferably may be acted upon hydraulically is provided for pivoting the swash plate which is arranged, in particular, in the region between a bearing surface of the control plate and the lid-shaped bearing flange which forms a pivot bearing arrangement for that of the driving shaft, which outwardly penetrates the bearing flange in a through-hole and is sealed in the region of the through-hole. The adjusting device is preferably the same for the rated quantities, so that the same adjusting device is suitable for the piston engine configured according to one or the other rated quantity.

In this connection, the adjusting device may have an effective direction and/or adjusting direction which is oriented transversely to the rotational axis of the drive unit.

The above object can be achieved by a second exemplary aspect of the present invention.

In the inventive piston engine according to the second exemplary aspect of the invention, the housing is also configured as a pot-shaped housing which is releasably closed by a lid-shaped bearing flange, the through-hole being arranged in the bearing flange, the driving shaft being rotatably mounted by a pivot bearing on the bearing flange and penetrating the through-hole, and the bearing flange comprising fastening elements distributed on a periphery which are components of a fastening device for fastening the piston engine to a support.

The recognition underlying the invention is that at the housing end of the piston engine, to which the driving shaft in the functional insert is connected to further drive elements, considerable loading occurs, said loads however being diverted to a large extent via the fastening elements into the respective support of the piston engine. Therefore, by ensuring sufficient stability it is possible to arrange the bearing flange at said end of the housing.

As a result, a dividing joint is produced in said end region of the housing, namely between the bearing flange and the edge of the pot-shaped housing facing said bearing flange. Nevertheless, sufficient stability of the housing is still produced. Moreover, the piston engine may be assembled and/or disassembled from said end of the pot-shaped housing on the drive side, whereby an arrangement is produced which is easy to assemble.

In this connection, it is particularly advantageous to arrange the swash plate on the inside of the bearing flange and to arrange the drive unit, in particular a control plate with a cylinder drum axially bearing thereagainst, on the bottom wall of the pot-shaped housing. As in most cases the driving shaft is connected axially displaceably and fixedly in terms of rotation to the cylinder drum, and the driving shaft penetrates the swash plate with considerable movement clearance, an arrangement which is easy to assemble results, by firstly the drive unit, together with the driving shaft, and then the swash plate being able to be assembled from the opening of the pot-shaped housing.

The embodiment according to the invention is very advantageously also suitable for a pivotable mounting of the swash plate on the inside of the bearing flange. In this connection, it is advantageous to configure the pivot bearing with bearing surfaces which are in the shape of a circular-arc portion and within bearing surfaces which are curved in a convex manner at the drive end of the housing. The bearing surfaces on the bearing flange side may be configured and prefabricated in a simple manner on the inside of the bearing flange. During the mounting of the bearing flange, the bearing surfaces automatically move into their bearing position.

In such a pivot bearing, the outer concave bearing surface in the shape of a circular-arc portion is configured in a relatively planar component, namely the bearing flange, whereby a position arranged deep inside the pot-shaped housing is unnecessary and said bearing surface may be produced in a more simple manner. This also applies to the mounting of the edge of a bearing surface, for example in the form of a bearing shell.

The inventive embodiment according to the second exemplary aspect of the invention is suitable, in particular, for being combined with at least two drive units of variable rated quantities which may be optionally installed, the drive units respectively only being able to be formed by the cylinder drum or even by the corresponding control plate and/or swash plate and/or corresponding pistons of different dimensions.

Moreover, the embodiments according to the invention are suitable for combining with an auxiliary pump arranged on the end of the housing remote from the bearing flange, i.e. in the external region of the bottom wall of the housing, the driving shaft thereof being coaxially arranged and preferably being connected fixedly in terms of rotation by a positively acting plug connection to the driving shaft of the piston engine. In this connection, within the scope of the invention, the pot-shaped housing may be configured such that optionally one of two auxiliary pumps of different rated quantities may be installed. Preferably, one respective gear pump is suitable as an auxiliary pump and/or auxiliary pumps, in the case of two gear pumps of different rated quantities, the gear pumps differing by a different axial depth.

In this connection, the piston engine is configured such that the pot-shaped housing is possibly suitable for accommodating a corresponding drive unit and possibly a corresponding auxiliary pump, preferably in the first case the smaller rated quantities being present and in the second case the greater rated quantities being present.

A further advantage of the inventive embodiment according to the second exemplary aspect of the present invention, comprises that the lid-shaped bearing flange is suitable for forming an adapter in order to adapt the piston engine to one respective support, so that the piston engine may be adapted to different fastening structures, for example from different manufacturers. In this connection, said fastening structures may, for example, be different fastening elements and/or screw elements on the support side.

At least two such different bearing flanges are thus respectively adapted to the respective fastening and centering elements of the support.

Developments of the invention as presented by the exemplary embodiments of the invention can be manufactured and installed in a simple manner as well as the simplification and improvement of the replacement of possible drive units and/or auxiliary pumps.

An embodiment of the invention is described in more detail hereinafter with reference to the drawings, in which:

DETAILED DESCRIPTION OF EXEMPLARY EMBODIMENTS

Figure 1:
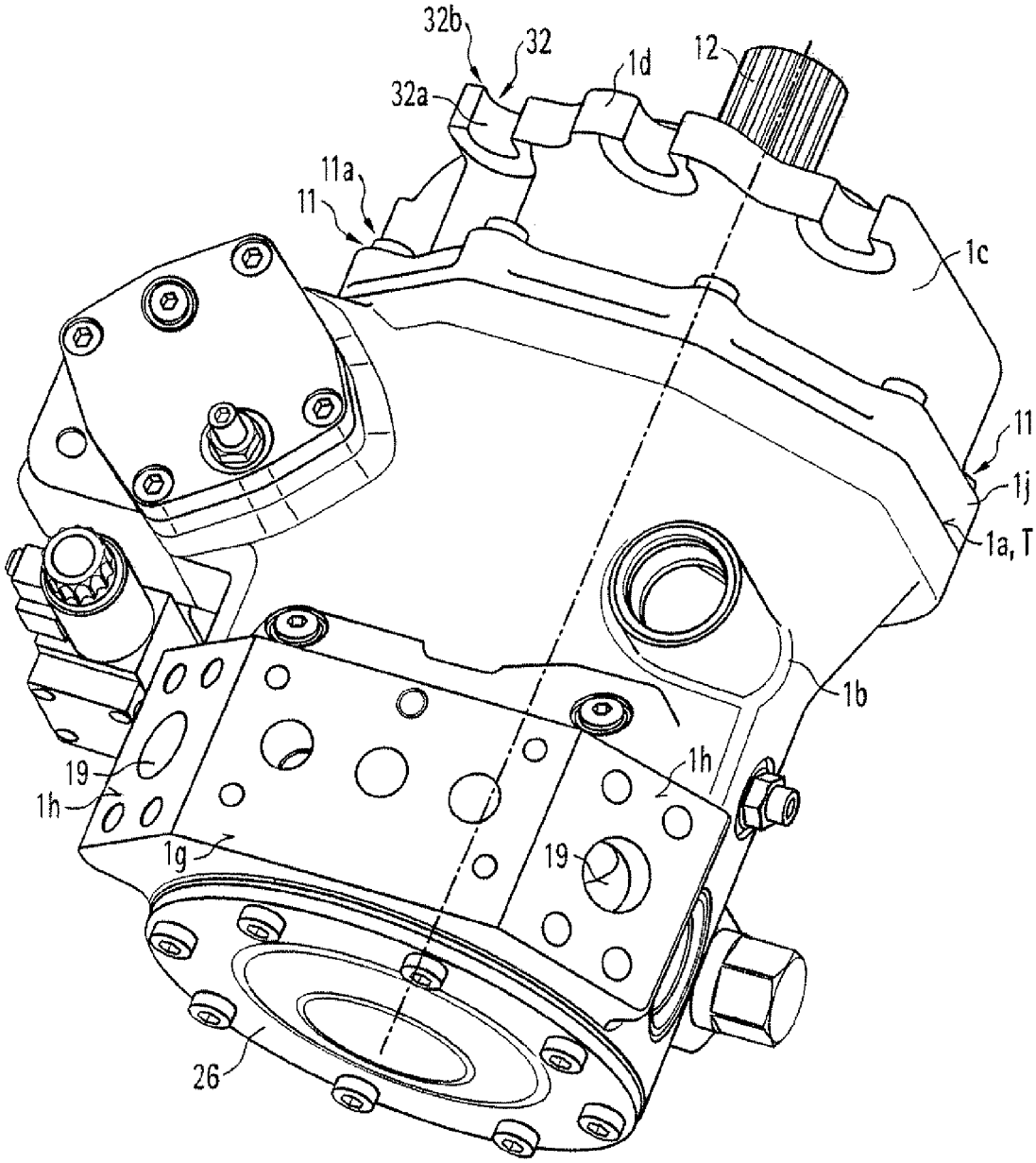
FIG. 1 shows a perspective view of an embodiment of the piston engine according to the invention.

On the front flange surface 1*a* of the pot-shaped housing 1*b* a bearing flange 1*c* is centrally arranged and screwed to the pot-shaped housing 1*b*. The centering may be carried out via pins or a centering collar. The flange surface 1*a* between the bearing flange 1*c* and the pot-shaped housing 1*b* is sealed outwardly by an O-ring or a flat seal 3*a*. For mounting the axial piston unit 4, the bearing flange 1*c* contains in its front region a fastening flange 1*d* and the centering collar 2*a*. In the bearing flange 1*c* two bearing shells 5*a* are arranged, in which respectively one bearing segment 5*b* with rolling elements is guided. The pivoting cradle 5*c* is pivotably arranged on the rolling elements of the bearing segments 5*b* and, via one respective bearing collar 5*d*, radially guided on the pivoting cradle 5*c* and the bearing shell 5*a*. The pivoting cradle 5*c* could also be arranged on plain bearing shells, which are pivotably arranged in the bearing flange 1*c*.

The bearing shells and/or plain bearing shells 5*a* are supported in the peripheral direction on the pot-shaped housing 1*b* and are thus secured against falling out through the pot-shaped housing 1*b*. The front driving shaft bearing 6*a* and a radial shaft sealing ring 7*a* are arranged in one respective central bore region of the bearing flange 1*c*. The front driving shaft bearing 6*a* is axially fixed in the bearing flange 1*c* by a bearing collar, not shown, and a locking ring 8. The radial shaft sealing ring 7 is arranged between two locking rings 8, 9.

For different requirements for the fitting or mounting of the axial piston unit 4, bearing flanges 1*c*1, 1*c*2 (FIG. 5) may be mounted which comprise different fastening flanges 1*d*, 1*d*1, 1*d*2 or centering collars 2*a*, and may be designed with the same screw diagram 11*a* for the pot-shaped housing 1*b*.

In order to resolve problems with insertion, bearing flanges 1*c* with the same screw diagram 11*a* as the pot-shaped housing 1*b* could be designed which produce and/or incorporate the fastening flange 1*d* in the region of the screwing plane.

The driving shaft 12 is rotatably mounted in a front and rear driving shaft bearing 6*a*, 6*b*. The cylinder drum 13 is connected fixedly in terms of rotation and axially movably to the driving shaft 12. The drive unit pistons 14 which are arranged axially displaceably in the cylinder drum 13 are supported via guide shoes 15 on the pivoting cradle 5*c*. The pivoting cradle 5*c* engages via a guide shoe 16*c* in a groove 16*b* of the actuating piston 16*a* of the adjusting device 16. The adjusting device 16, which in the embodiment is arranged transversely to the driving shaft axis 12*a*, is almost enclosed by the pot-shaped housing 1*b*.

The cylinder drum 13 and the drive unit piston 14 are set in rotation by the driving shaft 12. If, by actuating the adjusting device 16, the swash plate 17 pivots relative to the cylinder drum 13, the drive unit pistons 14 carry out a lifting motion. When rotating the cylinder drum 13 by 360°, each drive unit piston 14 performs a suction stroke and a compressive stroke, and corresponding oil flows being produced, the supply and removal thereof being carried out via the control apertures, not shown, in the control plate 18, the control apertures, not shown, in the pot-shaped housing 1*b* and the high pressure connection and/or low pressure connection. The control apertures in the pot-shaped housing 1*b* are designed to be the same for several rated quantities of the product series of the axial piston unit 4.

The operating connections 19, i.e. the high pressure connection and the low pressure connection, are configured in the pot-shaped housing 1*b* and arranged in the region between the bearing surface 1*e* of the control plate 18 and the rear flange surface 1*f* of the pot-shaped housing 1*b*. The operating connections 19 are designed in a 450 position on the pot-shaped housing 1*b*.

The mounting face 1*g* for a feed pressure filtering device intersects the mounting surfaces 1*h* for the operating connections 19 at an angle W of 45°. Moreover, the suction line connection and the tank connections are arranged in the pot-shaped housing 1*b*.

An auxiliary pump 22 is arranged in a radially widened portion 21 in the rear region of the pot-shaped housing 1*b*. The externally toothed inner rotor 22*a* of the auxiliary pump 22 is arranged fixedly in terms of rotation and axially movably on a stub shaft 23. The stub shaft 23 is connected fixedly in terms of rotation and axially movably via a toothing 24 to the driving shaft 12 and is axially supported via an O-ring 25 on the driving shaft 12 and via a collar 23*a* on the inner rotor 22*a* of the auxiliary pump 22.

The stub shaft 23 is rotatably mounted in the pot-shaped housing 1*b* and in the pump flange 22*c* of the auxiliary pump 22. The inner rotor 22*a* of the auxiliary pump 22 is arranged in engagement with an internally toothed outer rotor 22*b* of the auxiliary pump 22, which is rotatably arranged in the pump flange 22*c* of the auxiliary pump 22. In the pot-shaped housing 1*b* and in the pump flange 22*c* of the auxiliary pump 22, projections for the auxiliary pump 22 are configured on the suction and pressure side. In the pot-shaped housing 1*b*, connections for the auxiliary pump 22 are configured on the suction side and pressure side. The pump flange 22*c* of the auxiliary pump 22 is fixed by a lid 26 which is screwed onto the rear flange surface 1*f* of the pot-shaped housing 1*b* in a recess 21 of the pot-shaped housing 1*b*.

The axial spacing b of the bearing surface 1*i* of the auxiliary pump 22 in the pot-shaped housing 1*b* from the rear flange surface 1*f* of the pot-shaped housing 1*b* is the same for at least two rated quantities of a product series of axial piston units 4. The required volumetric delivery of the auxiliary pump 22 is thus implemented via auxiliary pumps 22*a*, 22*b* of corresponding depth.

Moreover, on the rear flange surface 1*f* of the pot-shaped housing 1*b* flanges may also be screwed, which allow the mounting of further axial piston units. On the rear surface 1*f* of the pot-shaped housing 1*b* no further apertures are provided for adjustments.

The embodiments of the piston engine described above may optionally be configured with or without the specifications described below.

Figure 2:
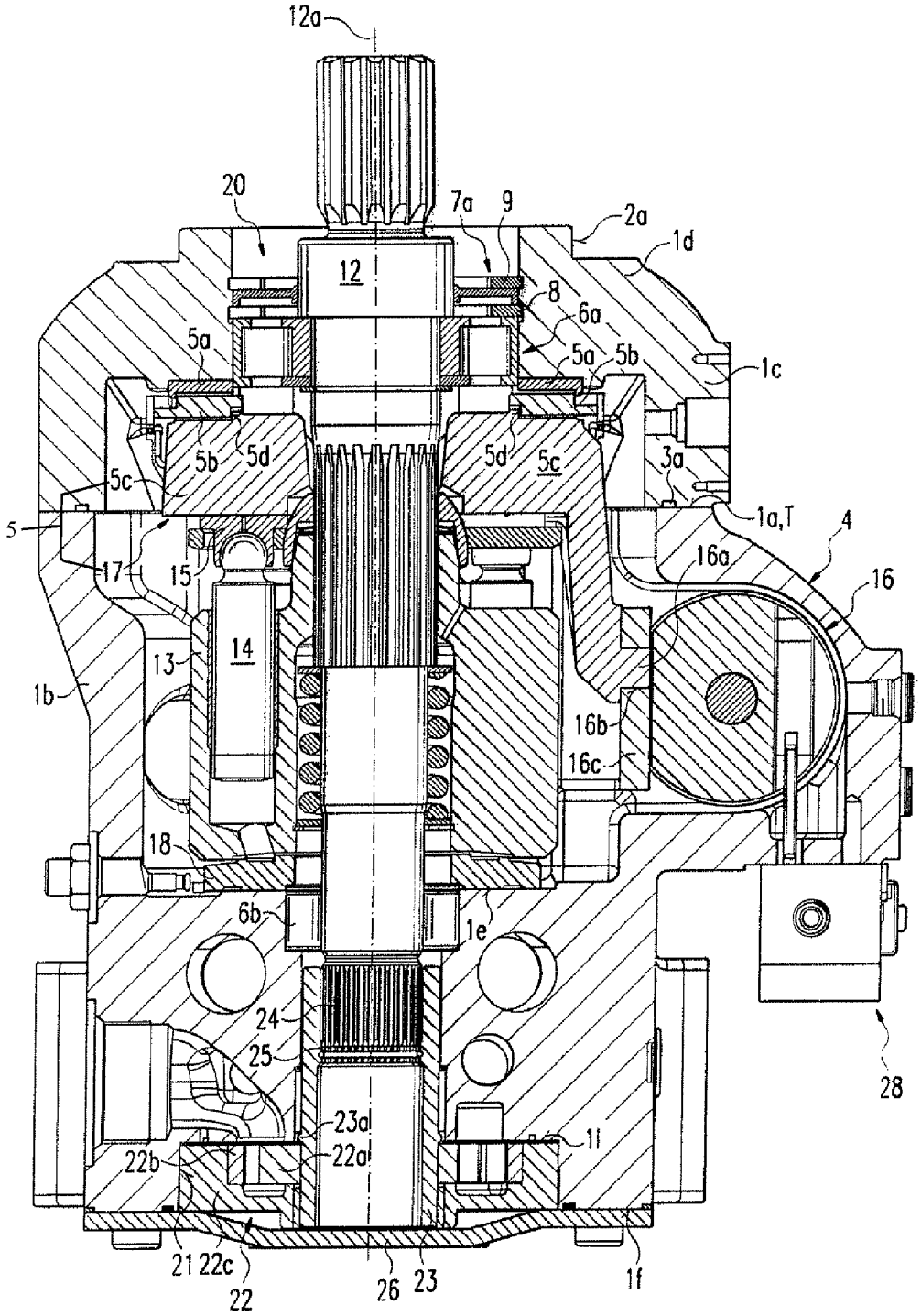
FIG. 2 shows a section through the embodiment of the piston engine according to the invention.
Figure 3:
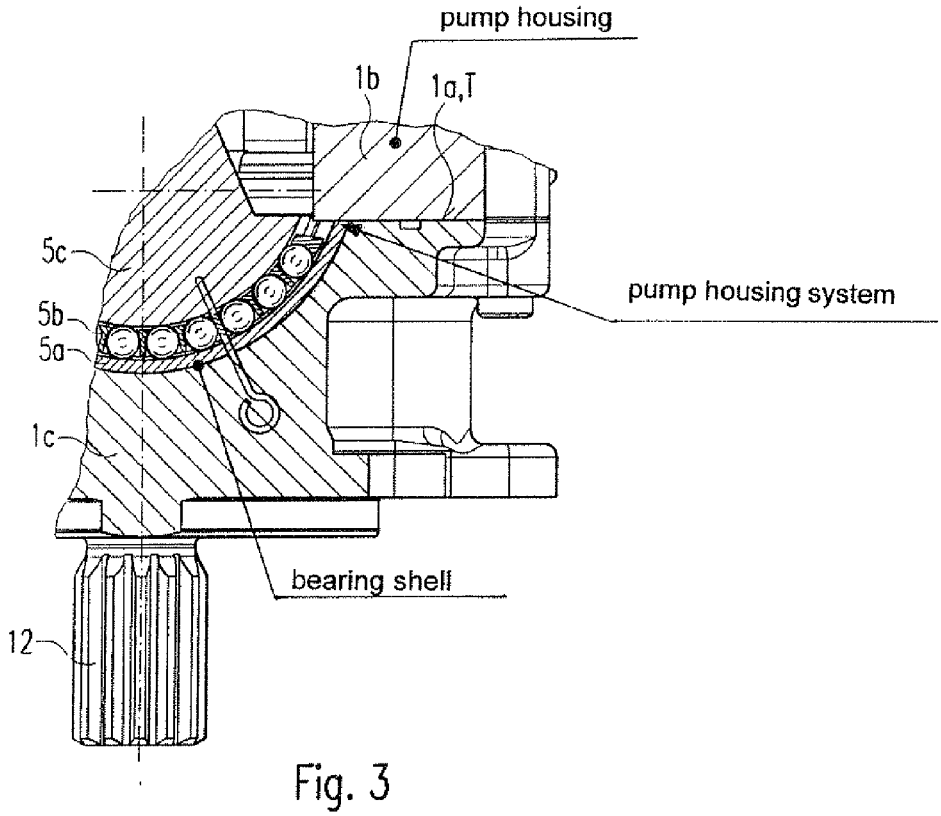
FIG. 3 shows a detail in section in the region of the bearing shell fixing of the embodiment of the hydrostatic piston engine according to the invention.
Figure 4:
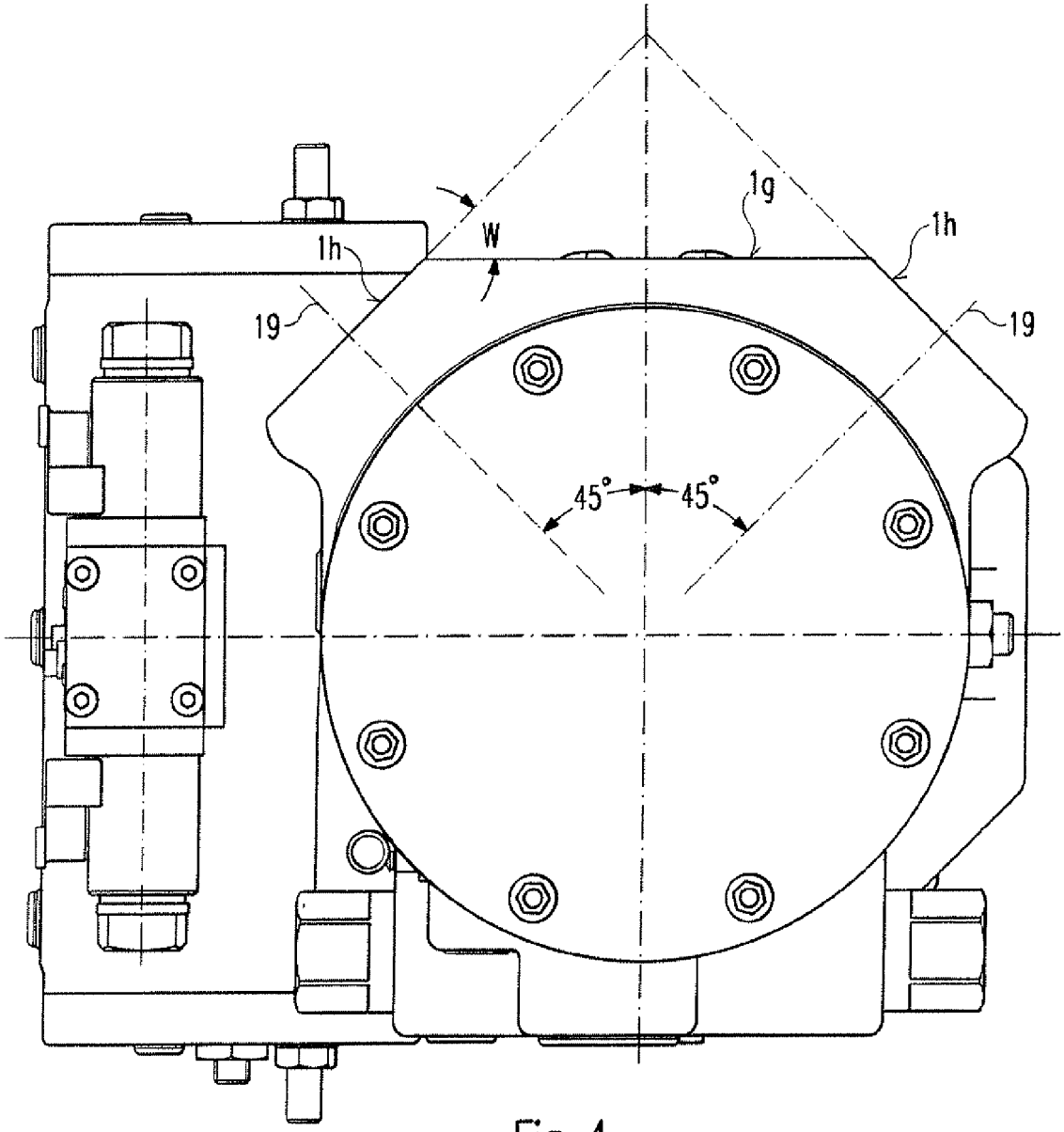
FIG. 4 shows a view of the front face of the hydrostatic piston engine according to the invention and FIG. 5 shows a sectional view, in which the assembly of a drive unit and an internal gear pump of different rated quantities may be seen in respectively the same pump housing.

The bearing shells 5*a* which are curved in the shape of a circular-arc portion have a transverse spacing from one another, the driving shaft 12 extending outwardly through a through-hole 20 arranged in the bearing flange 1*c* in the free space arranged therebetween. The pivot bearing denoted in its entirety by 5, for the pivoting cradle 5*c* and thus also for the swash plate 17, is formed by the bearing surfaces and/or plain bearing surfaces in the shape of a circular-arc portion and curved in a concave manner on the bearing shells 5*a* and thus in rolling and/or sliding contact with plain bearing surfaces in the shape of a circular-arc portion and curved in a convex manner on the front face of the pivoting cradle 5*c*. As may be seen from FIG. 2, the pivoting cradle 5*c* is positively positioned with the swash plate 17 by the two bearing collars 5*d* in the longitudinal direction of the transversely extending pivot axis.

The bearing shells 5*a* are positively supported in their peripheral direction on the pot-shaped housing 1*b*. They extend in the embodiment with their lateral ends as far as the dividing joint T formed by the flange surface 1*a* and/or to the corresponding bearing surface of the bearing flange 1*c*.

Figure 5:
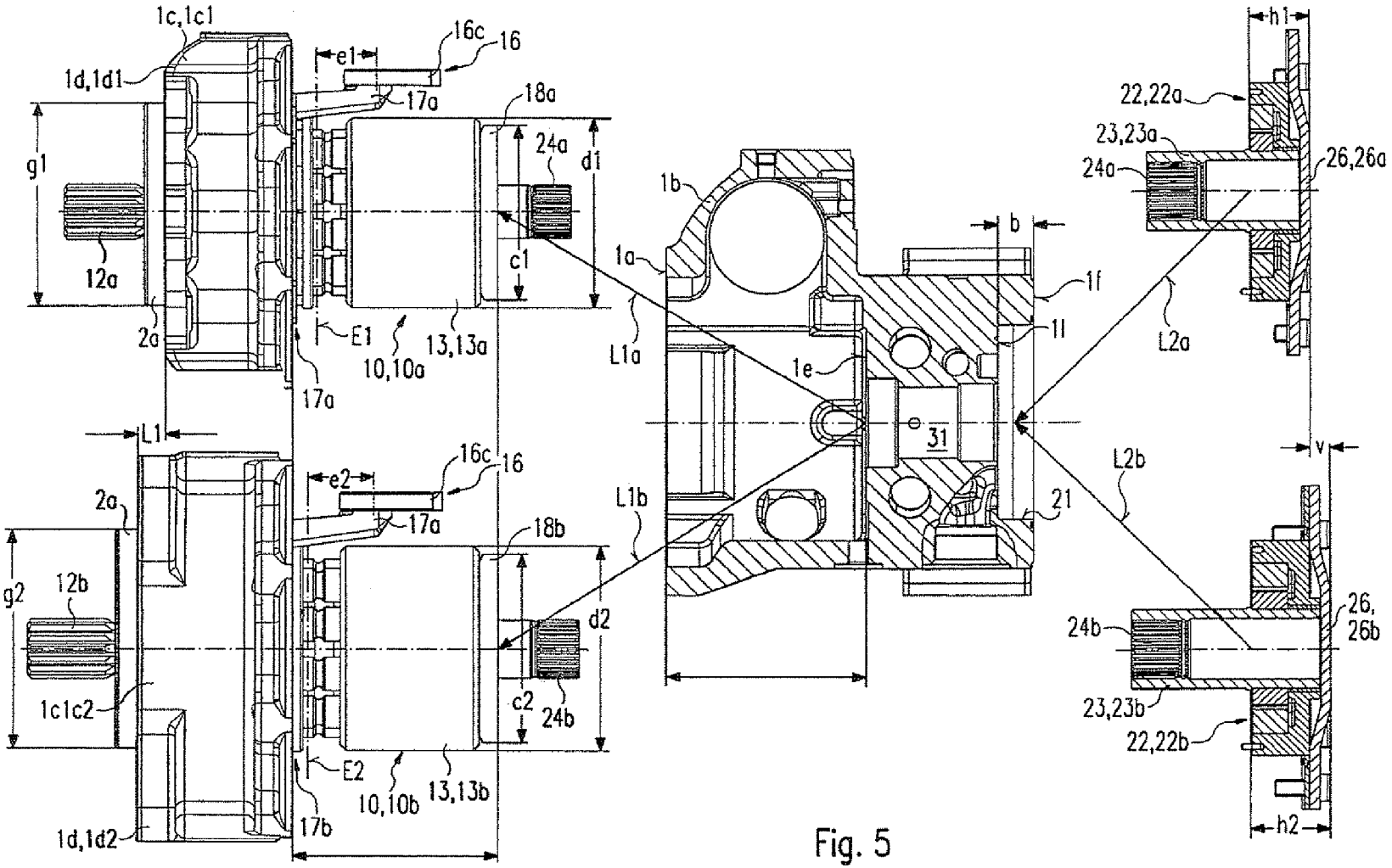

As FIG. 5 shows schematically, the pot-shaped housing 1*b* of the piston engine configured as an axial piston engine, may optionally be equipped with a drive unit 10 or one of two drive units 10*a*, 10*b* of different rated quantities and/or a bearing flange 1*c* or one of two different bearing flanges 1*c*1, 1*c*2 and/or with an auxiliary pump 22 or one of two auxiliary pumps 22*a*, 22*b* of different rated quantities. In this case, the installation depth A of the pot-shaped housing 1*b*, namely the axial spacing between the front flange surface 1*a* and the bearing surface 1*e* and/or between the rear bearing surfaces of the bearing flange 1*c* and the control plate 18 bearing against the bottom wall of the pot-shaped housing 1*b* is the same.

For the mounting of auxiliary pumps 22*a*, 22*b* of different depths, corresponding lids 26*a*, 26*b* with different axial offsets are provided, the different axial offset thereof being denoted by v. The axial dimensions of the auxiliary pumps 22*a*, 22*b* are denoted by h1, h2.

Within the scope of the invention, drive units 10*a*, 10*b* of different rated quantities differ from one another as the cylinder drums 13*a*, 13*b* have different diameters d1, d2 whereby, for example, cylinder chambers of different sizes may be produced in the cylinder drums 13*a*, 13*b* which are axially defined by the corresponding pistons 14.

In this case, for the cylinder drums 13*a*, 13*b* of different rated quantities, the corresponding control plates 18*a*, 18*b* may be configured in the same size or different sizes, see the cross-sectional dimensions and/or diameters c1, c2. The cross-sectional sizes of the pistons may also be the same or different sizes with different drive units 10*a*, 10*b*.

Two different bearing flanges 1*c*1, 1*c*2 may possibly be installed for different reasons. One reason may be, for example, for adapting to drive units 10*a*, 10*b*, of different rated quantities, to provide a different axial position for the, for example, adjustable swash plate 17. In such an embodiment, different axial positions of the oblique surfaces of the swash plate 17 are produced which, in FIG. 5, is illustrated by different transverse planes E1, E2. An adjusting device 16 is provided in the embodiment according to FIG. 5, which comprises an adjusting member 16*c* in the form of a pushing and pulling member extending transversely to the driving shaft axis 12*a* which acts on a lever 17*a*, which extends from the swash plate 17 on the outside of the corresponding cylinder drum 13*a*, 13*b* into the interior of the pot-shaped housing 1*b*. With axially offset swash plates 17*a*, 17*b*, as shown in FIG. 5, different lever lengths e1, e2 result between the connecting points with the adjusting member 16*c* and the corresponding plane E1, E2.

The bearing flanges 1*c*1, 1*c*2, may have different axial lengths, the difference in length thereof being denoted in FIG. 5 by L1.

Within the scope of the invention, the bearing flange(s) 1*c*, 1*c*1, 1*c*2 may also fulfil the function of an adapter. To this end, the bearing flange(s) 1*c*, 1*c*1, 1*c*2 on its(their) sides facing the pot-shaped housing 1*b*, comprises (comprise) fastening elements distributed on the periphery which respectively form with corresponding fastening elements on the pot-shaped housing 1*b* a fastening device 11 which in the embodiment is formed by a screw connection with screws 11*b* which screw a rear fastening flange 1*j* in a specific hole pattern 11*a* to the pot-shaped housing 1*b*.

On the axially opposing side i.e. on the side on which the bearing flange 1*c* faces a support, not shown, the bearing flange 1*c* comprises fastening elements 32*a* distributed on a periphery which cooperate with fastening elements, not shown, on the support and form a fastening device 32 shown by way of indication, which is also formed in the embodiment by a screw connection, the hole pattern 32*b* thereof being able to be variable for the purpose of adapting to different hole patterns of the support, not shown.

The function of the adapter may, for example, also relate to the centering 2 which may be configured on the different bearing flanges 1*c*, 1*c*1, 1*c*2 with different dimensions, for example different diameters g1, g2.

Within the scope of the invention, different drive units 10*a*, 10*b* may be fitted onto different driving shafts 12*a*, 12*b* which, for example, have different cross-sectional dimensions. In the embodiment, in such a case, corresponding stub shafts 23*a*, 23*b* of different cross-sectional sizes are also present which comprise toothings 24*a*, 24*b* matching the toothing of the corresponding driving shaft 12*a*, 12*b*. The driving shaft 12 penetrates the rear region of the pot-shaped housing 1*b* in a through-hole 31 with one or two bearing points, axially spaced apart from one another.

The subsidiary lines denoted in FIG. 5 by L1*a*, L1*b* and L2*a* as well as L2*b* illustrate the bearing points of the drive units 10*a*, 10*b* and auxiliary pumps 22*a*, 22*b* when they are respectively inserted into the pot-shaped housing 1*b* and bear with the respective control plate 18*a*, 18*b* and/or the corresponding elements of the auxiliary pump 22*a*, 22*b* against the corresponding bearing surfaces 1*e*, 1*i*.

Although not being described in detail in the application, a person of ordinary skill in the art understands that other peripheral, additional or known structures or features can be incorporated to the hydrostatic piston engine described above, for fulfilling the intended or additional functions of the engine. For example, pressure cut-off valves and feed pressure valves can be arranged in the pot-shaped housing of the engine.

The invention is not restricted to the embodiment shown. All the features disclosed and illustrated may be combined in any desired combination with one another within the scope of the invention.

The invention claimed is:

1. A hydrostatic piston engine comprising:

a drive unit having a rated quantity;

a swash plate;

a housing configured to accommodate the drive unit, the housing comprising a top end defining a top opening through which the drive unit is received in the housing, the housing further comprising a bottom end opposite to the top end; and a lid-shaped bearing flange releasably attached to the top end of the housing for closing the top opening of the housing, the lid-shaped bearing flange having an inner surface on which a bearing shell is provided, the swash plate being arranged on the bearing shell, such that the swash plate can be assembled from the top opening of the housing;

a driving shaft rotatably mounted in the housing, the driving shaft being connected fixedly in terms of rotation to the drive unit and penetrating the housing in a through-hole in a manner which is outwardly sealed, wherein the drive unit is formed by a cylinder drum connected fixedly in terms of rotation to the driving shaft, the cylinder drum comprising a piston bore in which a piston is mounted for reciprocal movement, the piston being axially supported on the swash plate, wherein an auxiliary pump is arranged in a region of the housing opposing the drive unit, and wherein, for mounting auxiliary pumps of different depths, corresponding lids with different axial offsets are provided.

2. The hydrostatic piston engine according to claim 1, wherein the lid-shaped bearing flange has a secondary through-hole and the driving shaft is rotatably mounted in a pivot bearing which sealingly penetrates the bearing flange in the secondary through-hole.

3. The hydrostatic piston engine according to claim 1, wherein the lid-shaped bearing flange comprises fastening elements distributed on a periphery which are components of a fastening device for fastening the piston engine to a support.

4. The hydrostatic piston engine according to claim 1, wherein the swash plate is pivotably mounted about a transversely oriented pivot axis, and the hydrostatic piston engine further comprises a hydraulic adjuster for adjusting a pivot angle of the swash plate.

5. The hydrostatic piston engine according to claim 1, wherein the bearing shell is supported in a peripheral direction on the housing.

6. The hydrostatic piston engine according to claim 4, wherein a control plate is provided on a bottom wall of the housing for controlling a supply and removal of hydraulic fluid, the hydraulic adjuster being arranged in a region between a bearing surface of the control plate and a connecting surface of the bearing flange.

7. The hydrostatic piston engine according to claim 4, wherein the hydraulic adjuster is substantially enclosed by the housing and same or different hydraulic adjusters are provided for at least two rated quantities.

8. The hydrostatic piston engine according to claim 4, wherein the hydraulic adjuster has a direction of adjustment which is transverse to a rotational axis of the drive unit.

9. The hydrostatic piston engine according to claim 1, wherein on the housing control and regulating devices are mounted which are configured to be the same for all rated quantities.

10. The hydrostatic piston machine according to claim 1, further comprising at least two operating connections, which extend at an angle of approximately 45° to one another.

11. The hydrostatic piston engine according to claim 10, wherein between the at least two operating connections a mounting surface is provided for mounting a feed pressure filtering device.

12. The hydrostatic piston engine according to claim 1, wherein pressure cut-off valves and feed pressure valves are arranged in the housing.

13. The hydrostatic piston engine according to claim 1, wherein a suction line connection and a tank connection are arranged in the housing.

14. The hydrostatic piston machine according to claim 1, wherein length ratios of a control plate and the bearing flange are dimensioned such that with a bearing of the control plate, a spacing of a flange surface of the bearing flange from a rear flange surface is the same, irrespective of the rated quantities of the drive unit.

15. The hydrostatic piston machine according to claim 1, wherein the lid-shaped bearing flange is attached to the housing through a predetermined screw diagram.

16. The hydrostatic piston engine according to claim 15, wherein different bearing flanges are screwed to the housing the predetermined screw diagram.

* * * * *